US006840585B2

(12) United States Patent
Clapham et al.

(10) Patent No.: US 6,840,585 B2
(45) Date of Patent: Jan. 11, 2005

(54) ROTARY CUTTING HEAD WITH WATER SUPPLY

(75) Inventors: William Stephen Clapham, Barnsley (GB); John Joseph Warren, Doncaster (GB)

(73) Assignee: Hydra Mining Tools International LTD (GB)

( * ) Notice: Subject to any disclaimer, the term of this patent is extended or adjusted under 35 U.S.C. 154(b) by 0 days.

(21) Appl. No.: 10/342,964

(22) Filed: Jan. 15, 2003

(65) Prior Publication Data

US 2003/0137184 A1 Jul. 24, 2003

(30) Foreign Application Priority Data

Jan. 16, 2002 (GB) ..... 0200880

(51) Int. Cl.[7] ..... E21C 35/23
(52) U.S. Cl. ..... 299/81.2
(58) Field of Search ..... 299/81.1–81.3

(56) References Cited

U.S. PATENT DOCUMENTS 4,516,807 A * 5/1985 Eagles ..... 299/1.6
4,660,892 A * 4/1987 Demoulin ..... 299/81.2
5,098,166 A 3/1992 Ebner et al.
5,114,213 A * 5/1992 Kornecki et al. ..... 299/81.2
5,507,565 A 4/1996 LeBegue et al.
5,690,392 A * 11/1997 Clapham ..... 299/81.1

FOREIGN PATENT DOCUMENTS

GB 2297989 8/1996
GB 2333548 7/1999

OTHER PUBLICATIONS

Great Britain Patent Office Search Report dated Mar. 15, 2003.

* cited by examiner

*Primary Examiner*—John Kreck
(74) *Attorney, Agent, or Firm*—Trexler, Bushnell, Giangiorgi, Blackstone & Marr, Ltd.

(57) ABSTRACT

A rotary cutting head (1) for a mineral mining machine, comprises a drive shaft (5) carrying a central drum (4), and beyond each end of the central drum (4), an outer drum (2,3), each drum being provided with an array of pick boxes (7) to receive an individual pick (8), wherein the drive shaft (5) has a longitudinal bore (10) housing at least one water conveying tube (11), which together with a network of bores (25) enable a single water admission cartridge interposed between an outer end of one of the drums (2), and an end face plate (16) of that drum (2) to supply water to all three drums (2, 3, 4).

3 Claims, 4 Drawing Sheets

ROTARY CUTTING HEAD WITH WATER SUPPLY

RELATED/PRIORITY APPLICATION

Figure 1:
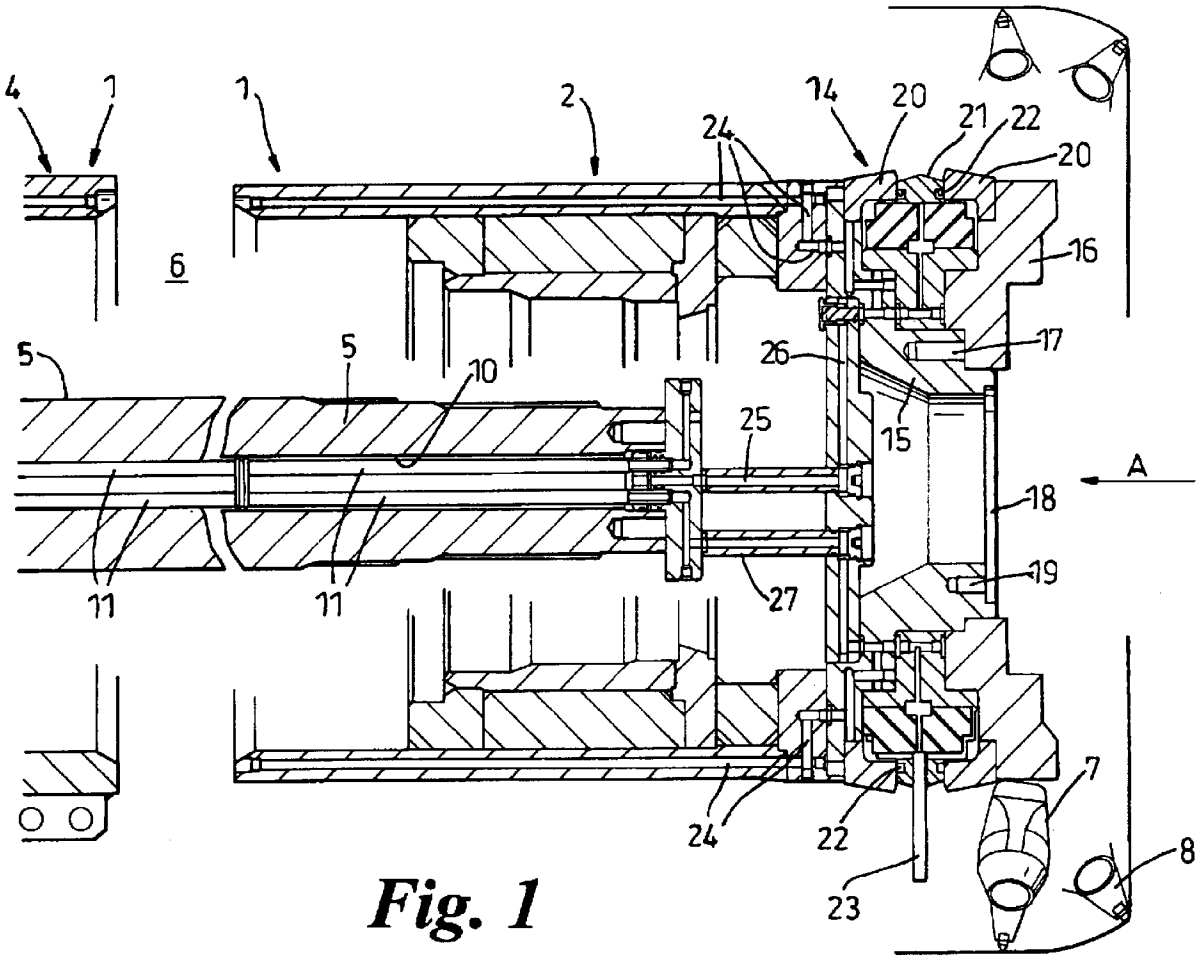

This application claims priority with respect to British Application No. 0200880.3, filed Jan. 16, 2002.

FIELD OF THE INVENTION

This invention relates to a rotary cutting head for a mining or tunnelling machine, and to a machine provided with such a cutting head.

BACKGROUND OF THE INVENTION

In GB 2297989, is described a so-called continuous miner, in which the hitherto "dry" rotary cutting head, comprising a drive shaft carrying a centre drum and two, co-axial outer drums, is provided with a safe supply of pressurised water whereby, if and when a water leak occurs, there is no leakage eg into a gear box, but only to an exterior part of the cutting head, and hence onto the mine floor. It was envisaged in GB 2297989 that each of the three drums would have its own individual water feed by a cartridge unit. This system has been used in practice and has had some degree of success. Inevitably, rotary water seals wear requiring the dismantling or changing of the cartridges, but the changing of the central cartridge, which by necessity was constructed in two halves and built around the central drum, was a long labourious procedure.

An advantage of the original three-cartridge system was the phasing of the water on the heads. This was threefold:

to reduce the amount of water used;

to prevent the machine operator from getting wet; and to encourage the movement of fresh air into a cut zone.

OBJECT OF THE INVENTION

A basic object of the invention is the provision of an improved rotary cutting head of the kind described in GB 2297989, and mining machine incorporating such a cutting head.

SUMMARY OF A FIRST ASPECT OF THE INVENTION

According to a first aspect of the invention, there is provided a rotary cutting head for a mineral mining machine, the head comprising a drive shaft carrying a central drum, and beyond each end of the central drum, an outer drum, each drum being provided with an array of pick boxes to receive an individual pick, wherein the drive shaft has a longitudinal bore housing at least one water conveying tube, which together with a network of bores enable a single water admission cartridge interposed between an outer end of one of the drums, and an end face plate of that drum to supply water to all three drums.

SUMMARY OF A SECOND ASPECT OF THE INVENTION

According to a second aspect of the invention, there is provided a mineral mining machine incorporating a rotary cutting head in accordance with the first aspect.

ADVANTAGES OF THE INVENTION

By means of the invention, the presence in the prior art of GB 2297989 of a central cartridge is avoided, with the single cartridge employed being in a readily accessible location, with the design and construction of the single cartridge being such, that it has the capacity to feed water to the entire cutter head.

PREFERRED OR OPTIONAL FEATURES OF THE INVENTION

Preferably multiple water conveying tubes are employed.

Preferably four water conveying tubes are employed.

The main drive shaft is bored to give a connection to all three drums. It is then a relatively simple matter to make a non-rotating water seal between all three drums and the drive shaft.

At least the four water conveying tubes are adapted to provide a phased supply of water, such that only a selected sector of drum is supplied with water, not only providing for more economical use of pressurised water, but also avoiding the soaking of the machine operator or other personnel in the vicinity.

In detail, if the water feed cartridge is located at the right hand head, then the four tubes provide a phased water supply to the left hand head along the longitudinal bore of the drive shaft.

The water supply to the central head may or may not be phased.

DETAILED DESCRIPTION OF THE DRAWINGS

Figure 2:
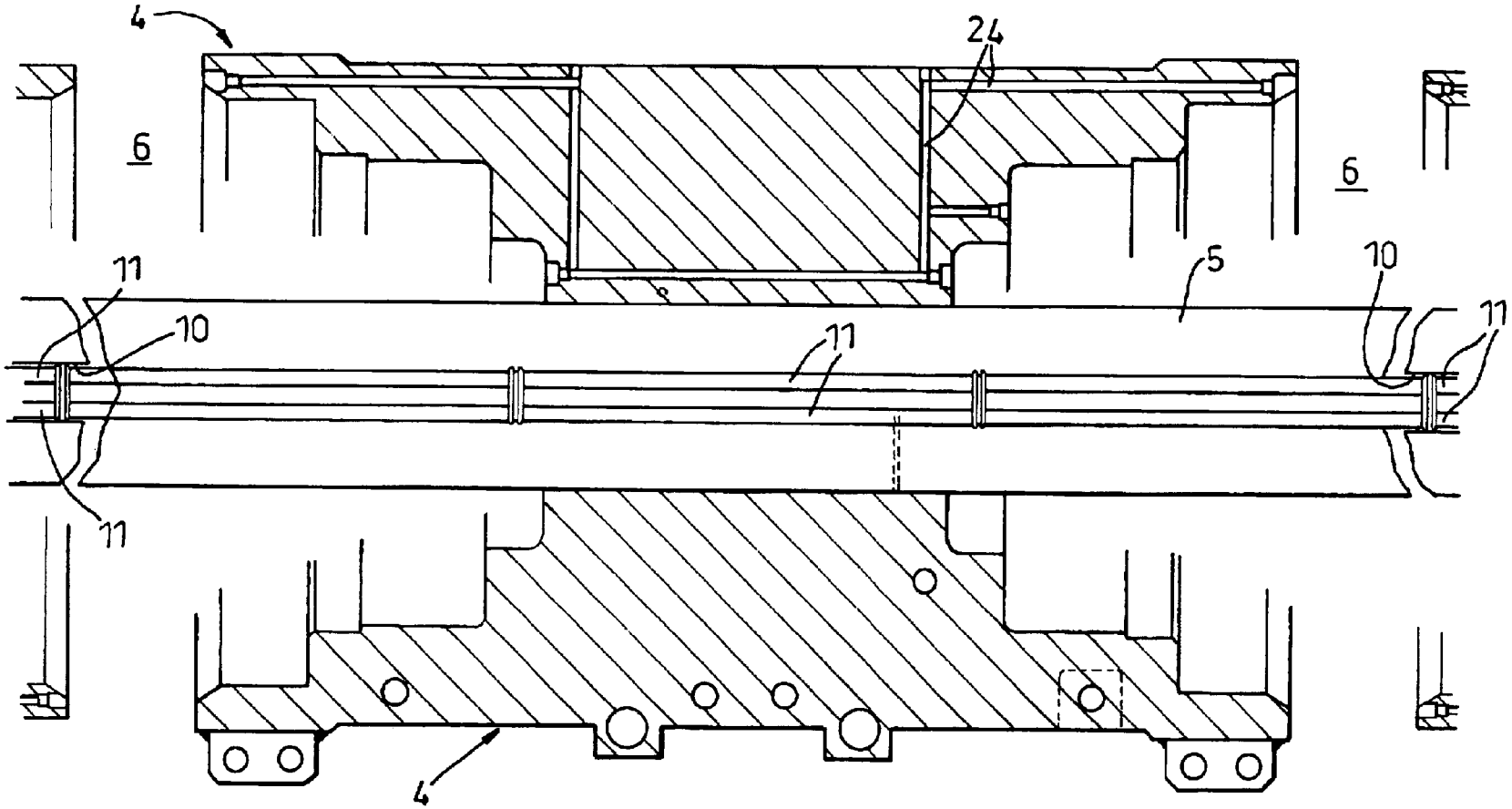
Figure 3:
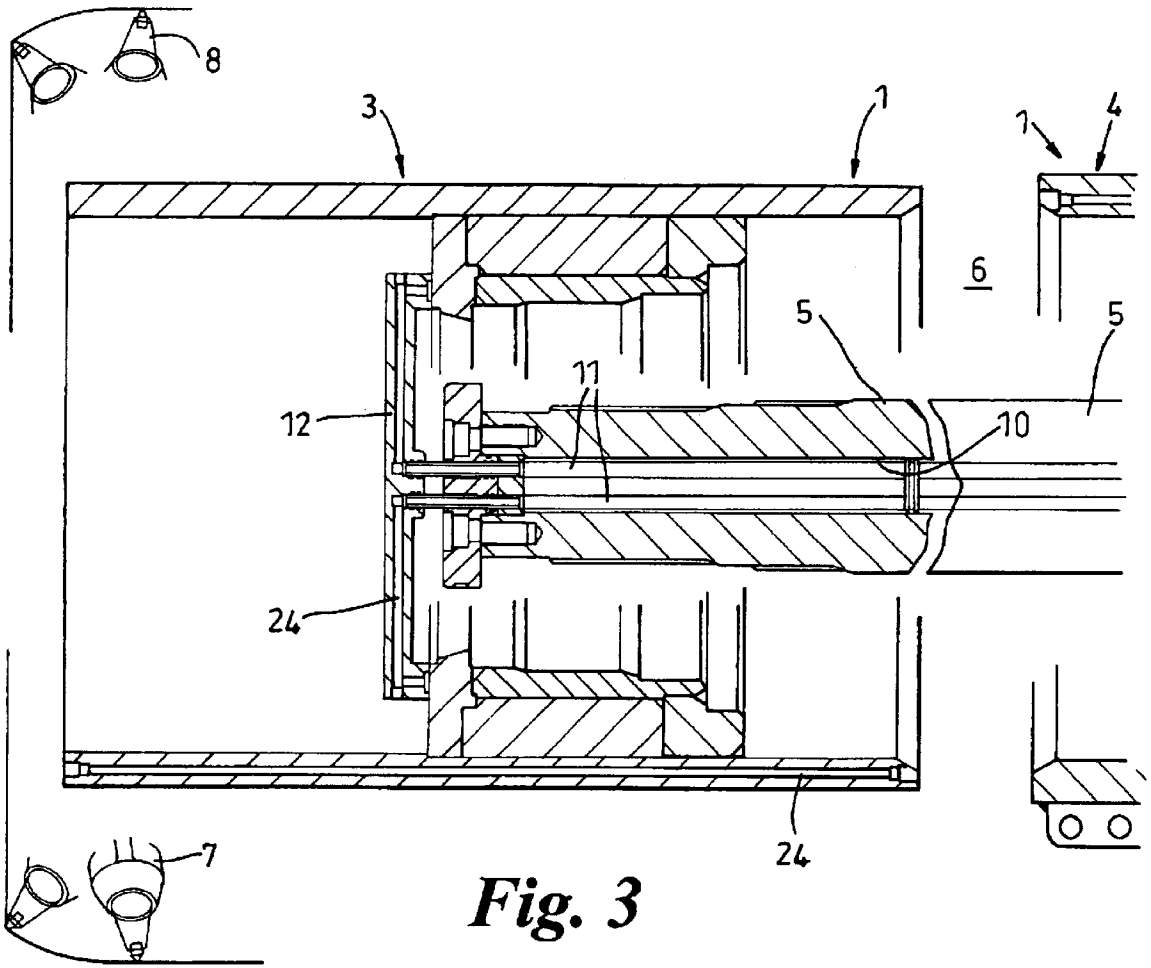
Figure 4:
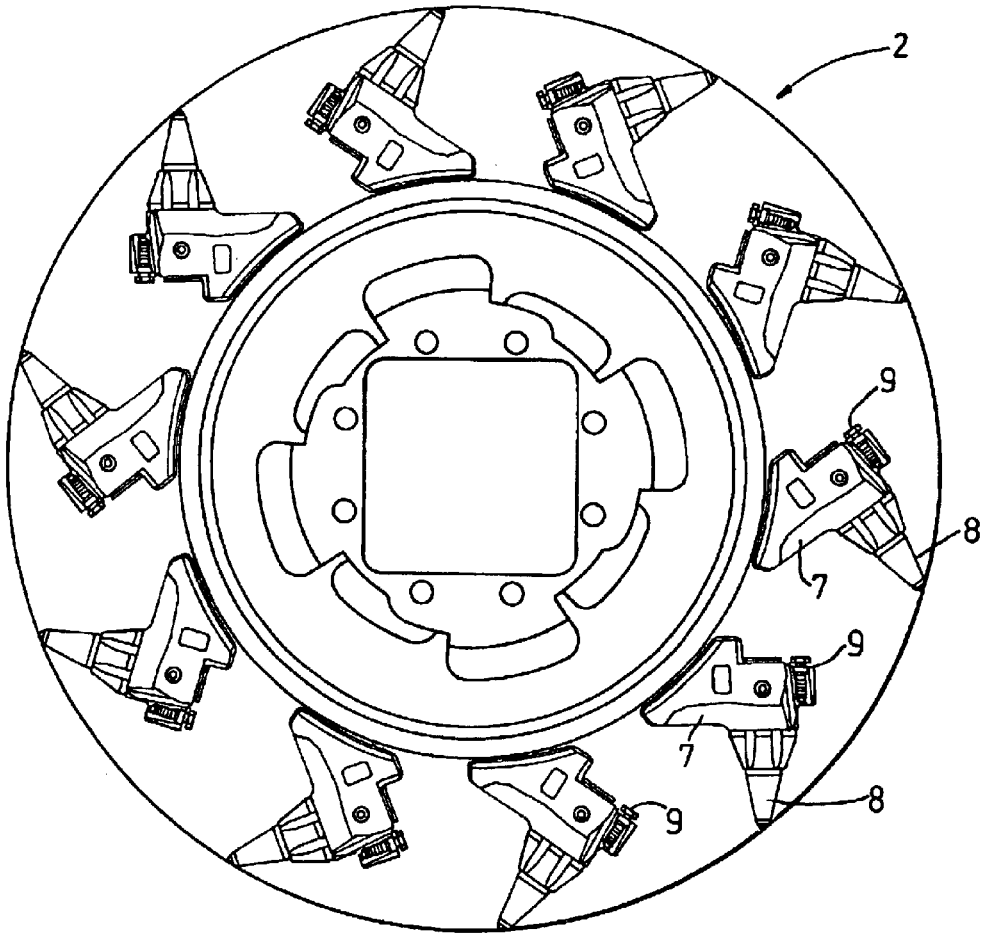

The invention will now be described in greater detail, by way of example, in which:

FIG. 1 is a longitudinal part sectional view of a right hand end of a rotary cutting head in accordance with the invention;

FIG. 2 corresponds to FIG. 1 but shows the centre portion of the rotary cutting head;

FIG. 3 corresponds to FIG. 1 but shows the left hand end of the rotary cutting head; and FIG. 4 is an end view of FIG. 1 in the direction of arrow A;

The rotary cutting head 1 in accordance with the invention comprises three co-axial drums, being a right hand outer drum 2, a left hand outer drum 3, and a central drum 4, the drums 2, 3 and 4 being secured on a common drive shaft 5, which is supported, in the well-known manner, from a pair of spaced-apart support arms projecting forwardly from a so-called continuous mining machine, the support arms housing a power drive train to the drive shaft 5, and being pivotally attached to the machine under the control of hydraulic rams to raise or lower the head 1, as dictated by mining requirements. The support arms penetrate the gaps 6 between each end of the central drum 4, and the adjacent ends of the left hand, and right hand, drums 3,2. For clarity, only FIGS. 1, 3 and 4 indicate pick boxes 7 that are welded at selected locations in a helical array around the drums 2, 3 and 4, each pick box being provided with a replaceable pick 8.

For a variety of well known reasons, water sprays are required and one spray nozzle 9 is usually associated with each pick box 7, but there exists the problem of introducing a water supply from a static supply pipe into a rotating cutting head 1. A solution for achieving water introduction, which avoids collateral damage to drive gears etc upon the inevitable failure of a water seal of the cutting head is described in GB 2297989/PCT/GB94/02518. When the rotary seal of this system fails, water falls harmlessly onto the mine floor.

The present invention is a refinement of this system, in that the drive shaft 5 has a central bore 10 provided with four water delivery tubes 11 to convey water from the right hand drum 2 to a distribution plate 12 attached to the left hand drum 3, and in the rotary cutting head 1 is provided a single water introduction cartridge 14, which is trapped between a square drive extension member 15 secured by bolts to adjacent end of the right hand drum 2, and an end face plate 16 secured by bolts 17 to the member 15, the cartridge 14 in turn being secured by bolts to the member 15.

The member 15 is closed off by a cover 18 secured by bolts 19 and outer protection rings 20 embrace the cartridge 14. A static three piece ring 21 has lip seals 22 engaging adjacent faces of the rings 20. A static and radially extending water feed arm 23 extends through the ring 21. From the arm 23, water is supplied to a water distribution network of the cutting head 1, comprising bores 24 supplying the right hand drum 2, and two axially extending pipes 25,27, supplied by bores 26. Pipe 25 supplies the central bore 10 and pipe 27 supplies the tube 11. From one or other of the tubes 11, water may readily be conveyed to the left hand drum 4 via distribution plate 12.

In accordance with the invention, the one cartridge 14 only serves to introduce water from a static supply source 23 to all three rotating drums 2, 3 and 4. Consequently, compared with GB 2297989, the number of high pressure seals (not shown) that can, and will fail or wear out, is reduced from three pairs to one pair. However, even when the one pair of high pressure seals either fails, or require scheduled replacement, the sole cartridge 14 is provided in a readily accessible location to enable repair or maintenance work to be effected with minimal down time.

What we claim is:

1. A rotary cutting head for a mineral mining machine, said head comprising a drive shaft, a central drum carried by said drive shaft, said central drum having two opposed ends, with an outer drum located beyond each of said ends, an array of pick boxes being provided on said central and said outer drums, each said pick box to receive an individual pick, characterized in that water is admitted to said cutting head at a single location only, which location is beyond an outer end of one of said outer drums where a water admission cartridge is interposed between said outer end of said one of said outer drums and an end face plate of that drum to supply water to all three said drums via a longitudinal bore provided along said drive shaft with at least one water conveying tube located within said bore in communication with a water distribution network, with any water leakage from said cartridge being external to said drums and hence incapable of effecting any collateral damage.

2. A rotary cutting head as claimed in claim 1, wherein four said water conveying tubes are employed to provide a phased supply of water to said outer drum.

3. A rotary cutting head as claimed in claim 1, wherein said water supply to said central drum is phased.

* * * * *